United States Patent [19]

Weber

[11] 4,181,478

[45] Jan. 1, 1980

[54] SEAL LIFE IN ROTARY MECHANISMS

[75] Inventor: John R. Weber, Chillicothe, Ill.

[73] Assignee: Caterpillar Tractor Co., Peoria, Ill.

[21] Appl. No.: 886,231

[22] Filed: Mar. 13, 1978

[51] Int. Cl.[2] ..... F04C 27/00

[52] U.S. Cl. ..... 418/51; 418/113

[58] Field of Search ..... 418/51, 53, 61 A, 113

[56] References Cited

U.S. PATENT DOCUMENTS

| | | | |
|---|---|---|---|
| 3,270,720 | 9/1966 | Ehrhardt | 418/61 A |
| 3,990,817 | 11/1976 | Ruf et al. | 418/61 A |

*Primary Examiner*—Leonard E. Smith

*Attorney, Agent, or Firm*—Wegner, Stellman, McCord, Wiles & Wood

[57] ABSTRACT

A rotary mechanism having improved seal life including a housing defining an operating chamber having a wall configuration based on a desired geometrical shape which is an n order harmonic curve where n is an integer of 1 or more, a shaft journalled in the housing and having an eccentric within the chamber, and a rotor within the chamber and journalled on the eccentric and having a working surface based on the desired geometric shape and which is an n+1 order harmonic curve to define n+1 equally angularly spaced apexes or noses on the surface. n+1 seals are carried by the rotor, one at each apex or nose and timing gearing interconnects the rotor and the housing to establish relative rates of rotation between the housing, the shaft and the rotor. The chamber wall further is defined by an n+1 harmonic curve superimposed on the n order harmonic curve which minimizes relative movement between the seal and the rotor to improve the life of the seals.

4 Claims, 3 Drawing Figures

0°
90°
180°
270°
TDC
BDC
60°
45°
H2
L2
100
102
104
106
360°
120°
30°
A
B
C

SEAL LIFE IN ROTARY MECHANISMS

BACKGROUND OF THE INVENTION

This invention relates to rotary mechanisms used as engines, pumps, compressors, expanders, or the like.

Over the years, there have been a variety of proposals for rotary mechanisms intended for use as engines, pumps, compressors, expanders, or the like, as substitutes for reciprocating mechanisms utilized for like purposes. In theory, at least, rotary mechanisms have distinct advantages over their reciprocating counterparts in that most rotary mechanism designs require considerably fewer moving parts than their reciprocating counterparts and are more compact.

Notwithstanding the substantial theoretical advantage, rotary mechanisms, many designs of which have been known for decades, have been slow to achieve commercial acceptance. And, it has been only in recent years when some types of rotary mechanisms, such as trochoidal mechanisms, have been commercially available.

The commercial introduction of rotary mechanisms was greeted with a great deal of enthusiasm, but is appears that the introduction was premature since, as field experience with such mechanisms increased, it soon became apparent that present state of the art rotary mechanisms could not live up to their billing for any of a variety of reasons.

One significant downfall of rotary mechanisms commercially available today is their inability to last as long as their reciprocating counterparts. And a considerable factor contriouting to the relatively short life of such mechanisms is the relatively short life of the seals used therein.

In particular, many such mechanisms utilize so-called apex or nose seals which are carried by a rotor at its apexes or noses in grooves formed in the rotor. One significant factor in maximizing the life of the seals is to design the mechanism such that relative movement between the seal and the rotor carrying the same is minimized or nonexistant, particularly when the seals are pressurized due to compressed gas and firmly urged into contact with the rotor.

Heretofore, this theoretical goal has been impossible to fully realize in an actual mechanism due to deflections, all be them small, of mechanical parts when loaded and relative movement of mechanical parts through small design clearances at their interface due to loading on the components.

SUMMARY OF THE INVENTION

The present invention is directed to overcoming one or more of the above problems.

According to the present invention, there is provided a rotary mechanism including a housing defining an operating chamber having at least one wall provided with n major lobes where n is an integer of 1 or more. A shaft is journalled in the housing and includes an eccentric within the chamber. A rotor is within the chamber and is journalled on the eccentric. The rotor has at least one surface provided with $n+1$ equally angularly spaced noses or apexes for sealingly engaging the chamber wall and defining with the wall, $n+1$ working volumes. The wall is further provided with $n+1$ equally angularly spaced minor lobes located to both sides of the major lobes such that the angular spacing between the major lobes and the adjacent minor lobes is substantially equal. In some instances, as when n is equal to 2, this may result in a minor lobe falling on one of the major lobes. The minor lobes are directed towards the rotor and extend into the chamber a distance sufficient to compensate for, to a desired degree, deflection of mechanical parts and relative movement of mechanical parts through small design clearances at their interface due to elevated pressure in one of the working volumes.

Other objects and advantages will become apparent from the following specification taken in connection with the accompanying drawings.

DESCRIPTION OF THE PREFERRED EMBODIMENT

Figures 1, 2, 3:
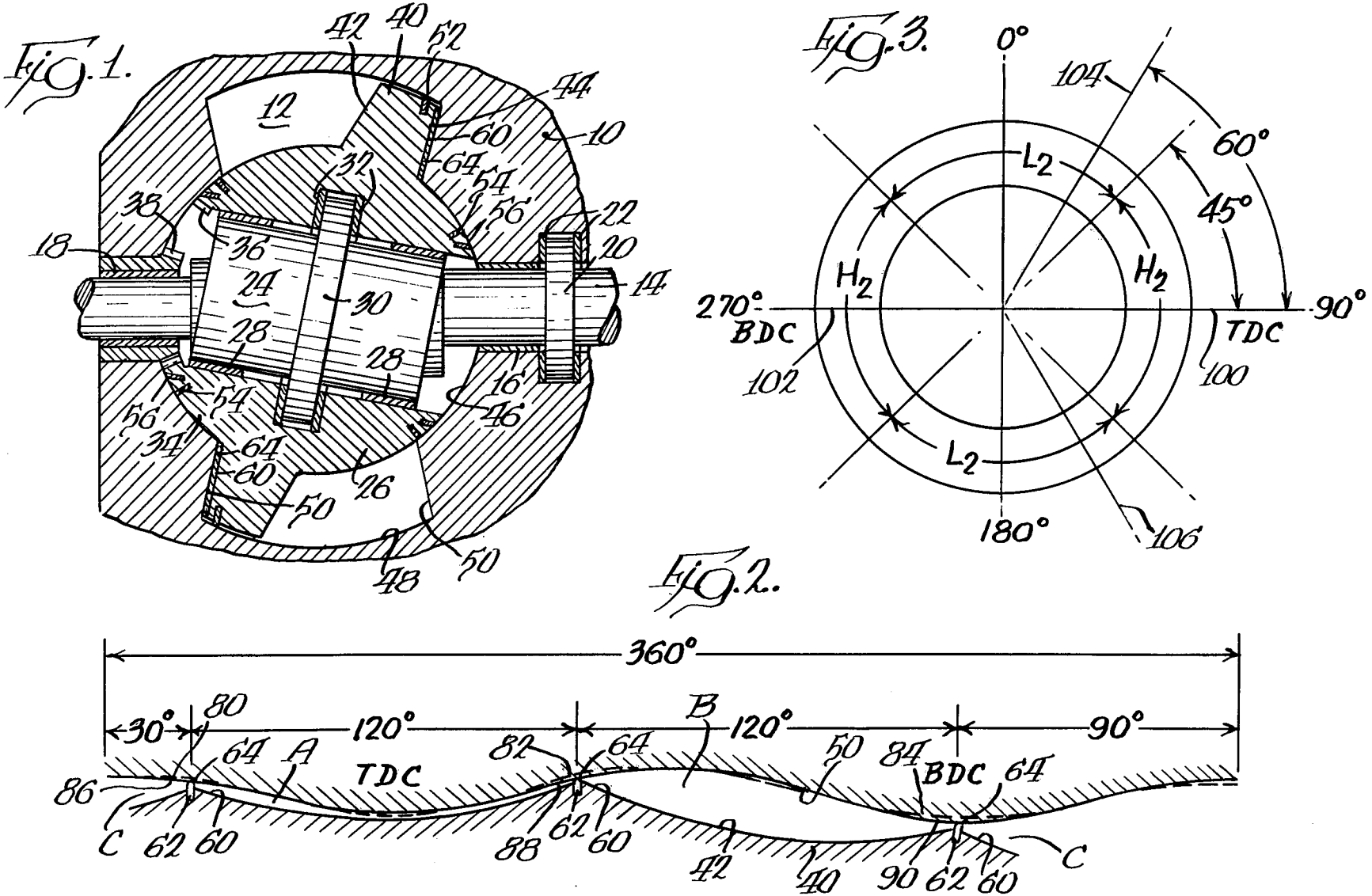
FIG. 1 is a sectional view of a rotary mechanism, specifically, a four-cycle, slant axis rotary engine, made according to the invention.
FIG. 2 is a somewhat schematic, developed view of one of the walls of the chamber of the mechanism in relation to a working surface of the rotor.
FIG. 3 is a schematic, graphical view.

An exemplary embodiment of a rotary mechanism made according to the invention is illustrated in the Figures and, with reference to FIGS. 1 and 2 is seen to be in the form of a four-cycle, slant axis rotary mechanism employed as an engine. However, it is to be understood that the invention is applicable to rotary mechanisms other than slant axis rotary mechanisms as, for example, trochoidal mechanisms and further is applicable to mechanisms other than four-stroke mechanisms as, for example, two-stroke mechanisms. As alluded to previously, it is desirable to minimize or eliminate relative movement between a rotor and apex or nose seals carried thereby and those skilled in the art will recognize that, in a slant axis rotary mechanism, such undesirable movement will occur generally in the axial direction whereas in a trochoidal mechanism, for example, such undesirable movement will occur generally in the radial direction. With this distinction in mind, from the following description of the invention as applied to a slant axis rotary mechanism, those skilled in the art will readily appreciate how the principles of the invention may be utilized to minimize undesirable relative movement between a seal and a rotor, whether axial or radial.

The mechanism includes a housing 10 defining an operating chamber 12. A shaft 14 is journalled in the housing 10 by bearings 16 and 18 and one end of the shaft is provided with a thrust collar 20 disposed between thrust bearings 22 carried by the housing 10 to absorb axial thrust applied to the shaft 14.

Within the chamber 12, the shaft 14 includes an angularly offset eccentric 24 which journals a rotor 26 by journal bearings 28. The eccentric 24 also carries a thrust collar 30 which is disposed between thrust bearings 32 carried by the rotor 26.

The rotor 26 includes a generally spherical hub 34 and one end of the same is provided with a ring gear 36 which is meshed with a gear 38. The gears 36 and 38 are timing gears to establish the relative rates of rotation between the shaft 14, the housing 10 and the rotor 26, the precise ratio dependent upon whether the mechanism is operating on the two-stroke principle, the four-stroke principle, etc.

The rotor 26 further includes a peripheral flange 40 having opposed working surfaces 42 and 44. The working surfaces 42 and 44 cooperate with internal walls of the housing 10 which define the operating chamber 12. In particular, the chamber 12 is defined by a radially inner spherical surface 46, a radially outer spherical surface 48 and opposed, facing, spaced, generally radially extending side walls 50. In a four-stroke mechanism, the walls 50 will have both a conical and sinusoidal configuration, the sinusoidal characteristics being readily apparent from FIG. 2.

The radially outer surface of the flange 40 carries peripheral seals 52 while the hub 34 carries hub compression seals 54 and oil seals 56.

Each of the working surfaces 42 and 44 is provided with three apexes 60 (FIG. 2) which are equally angularly spaced, that is, 120° apart. It is to be noted that the apexes 60 on the surface 42 are staggered with respect to the apexes on the surface 44 in a known fashion, and at each apex a seal receiving groove 62 which opens towards the adjacent wall 50 is provided. Within each groove 62 there is disposed an apex seal 64 which extends out of the associated groove into sealing engagement with the adjacent wall 50. In the usual case, the geometry of the seal 64 and the groove 62 will be such that gas under pressure may enter the groove 62 to provide gas energization of the seal 64 and a small biasing spring, for startup purposes, may also be disposed in the groove.

Referring to FIG. 2, it will be seen that the foregoing construction yields a configuration of the wall 50, in a four-stroke mechanism, having two major lobes, the first of which is labeled TDC and the second of which is labeled BDC for top dead center and bottom dead center, respectively. It will also be appreciated that the number of apexes 60 is equal to the number of major lobes plus 1.

Those skilled in the art will similarly recognize that in a four-stroke trochoidal mechanism, there will be two major lobes which define the so-called "waist" of the operating chamber and that the rotor will have three apexes if an epitrochoidal mechanism and three noses if a hypotrochoidal mechanism. Lastly, it will be appreciated that if the mechanism operates on a two-stroke principle, there will be but a single lobe on the housing wall and but two apexes or noses on the rotor. In all cases, the apexes will be equally angularly spaced as will be the major lobes if more than one is utilized.

In mathematical or geometrical terms, the housing wall of a two-stroke mechanism in a developed view will be that of a first order curve while the working surface of the rotor will be a second order harmonic curve thereof. In a four-stroke mechanism, in developed view, the wall configuration will be that of a second order harmonic curve while the rotor working surface configuration will be a third order harmonic curve.

In any type of mechanism, the housing wall configuration will be based on some desired geometric shape. For example, the basic sinusoidal and conical shape of a wall 50 in a four-stroke slant axis rotary mechanism is determined by various design factors when applied to mathematic equations known in the art. Similarly, in a epitrochoidal mechanism, the wall shape will be based on some desired epitrochoid, while in the case of a hypotrochoidal mechanism, the wall shape will be based on some desired clearance envelope of a hypotrochoidal rotor shape.

At the same time, in a slant axis rotary mechanism or in an epitrochoidal mechanism, the rotor shape will be based on some desired clearance envelope determined by the wall shape while in the case of a hypotrochoidal mechanism, the rotor shape will be based on the desired hypotrochoid.

It is significant to understand that in any of the above events, the various shapes need not fully conform to the desired geometrical shape, since, as is well known, in many instances, the various shapes are altered somewhat dependent upon seal radius, for example, or the desirability of providing continuous curves at various lobes, particularly on the housing walls, to eliminate scuffing. In other cases, there will be a deviation from the basic geometric shape to increase compression ratio. The present invention is applicable to any such mechanisms, including those wherein deviations are made from the theoretical geometric shape for any of the above purposes or other like purposes.

The present invention contemplates a further deviation from the basic geometric shape, whether modified or unmodified. As seen in FIG. 2, the basic wall shape of the wall 50, as would be present in a slant axis rotary mechanism operating on the four-stroke principle made according to prior art teachings is that shown in dotted lines whereas the wall configuration made according to the invention is that shown in solid lines. Where the two substantially coincide, only a solid line is shown.

Considering but a single working surface 42 of the rotor 26, it will be appreciated that the space between each apex 60 defines a working volume. Thus, a first working volume is designated A in FIG. 2 while a second is designated B and a third is designated C. Maximum pressure applied to the side of the flange 40 of the rotor 26 will occur in the working volume A for the configuration of components shown in FIG. 2 since that is at the top dead center point of the mechanism. A lesser pressure will be present in the working volume B since, as can be seen, the same has expanded. The same will be true with respect to the working volume C.

In actuality, for the configuration illustrated, the pressure in the working volume C will be at a minimum value since typically, porting, such as exhaust or intake ports, when the mechanism is used as an engine, will be located at or around bottom dead center and the chamber C will have accordingly been vented.

In any event, the high pressure in the working volume A will tend to push the flange 40 away from the wall 50, generally in an axial direction. And, in fact, some such movement will occur. Specifically, even though the housing 10 and the rotor 26 will be formed of a rigid material, usually metal, some deflection will occur. Moreover, since bearings and the like are typically provided with small design clearances, the force applied by the elevated pressure will tend to take up such small clearances. Consequently, the resulting tendency for separation between the wall 50 and the surface 42 would result in the apex seals 64 having to move axially outwardly in their grooves 62 to maintain sealing engagement with the wall 50. And, as can be seen from FIG. 2, were the wall 50 configured according to prior art teachings, the seal 64 would, for the configuration of the components illustrated in FIG. 2, move outwardly sufficiently to ride against the prior art wall designated by the dotted lines 80, 82 and 84.

To eliminate such motion, minor lobes 86, 88, and 90 are placed on the wall 50 such that they are equally angularly spaced an amount equal to the spacing between apexes 60 and located to either side of the major lobes a substantially equal distance, as seen in FIG. 2. In some instances, as when n is equal to 2, this may result in a minor lobe falling on one of the major lobes. As a consequence, in a sense, as the rotor working surface 42 begins to move away from the wall 50 due to increasing compression in one of the working volumes as top dead center is approached, the seal 64 will similarly be moved away from the prior art envelope by the presence of the minor lobes 86 and 88.

In this connection, it should be observed that the lobe 90, at bottom dead center, is not required and could be eliminated if desired since the seals 64 at bottom dead center are subject to little or no pressure with the consequence that very little friction will be present between the seals 64 and the walls of the corresponding groove 62 at that point.

Stated another way, the wall 50, if considered to be configured according to an n order harmonic curve, as stated previously, has an n+1 harmonic curve configuration superimposed on the basic n harmonic curve to provide the lobes 86, 88 and 90 which, in turn, extend toward the rotor and into the operating chamber 12.

With reference to FIG. 3, for the four-stroke slant axis rotary mechanism illustrated, the location of the centers of the various lobes is illustrated. Top dead center or one major lobe is indicated at 90° and will fall on the line 100. The other major lobe falls on the line 102 at 270° or at bottom dead center. The minor lobe 86 will have its maximum on a line 104 60° in advance of top dead center or 30° from the zero point. The minor lobe 88 will have its center on a line 106 60° behind top dead center while the maximum of the lobe 90 will coincide with the major lobe and fall on the line 102. It is, however, contemplated that such locations may deviate a few degrees from those locations specified immediately preceding dependent upon engine timing, etc. It is desired that they be such that seals 64 will be on the location of the maxima of the minor lobes at peak pressure. Should peak pressure occur slightly in advance of top dead center, the minor lobes would be shifted somewhat towards the 0° mark. Should the compression occur slightly after top dead center, the maximum point of the minor lobe would be shifted away from the 0° mark.

In a slant axis rotary mechanism, the shift between the components will be generally axial in nature and will be attributable to both the takeup of clearance in bearings or the like and to deflections induced by pressure. In considering the nature of the n+1 harmonic curve used to generate the minor lobes, the takeup of clearances in the main thrust bearing 20, 22, the main journal bearing 16 and 18, the rotor thrust bearing 30 and 32 and the rotor journal bearing 28 must be considered. With respect to deflections, those occurring in the main thrust bearing 20 and 22, the shaft 14 and the rotor thrust bearing 30 and 32 must be considered.

For examplary purposes, the following table charts both bearing takeup and deflection in slant axis rotary engines operating on the four-stroke principle having a design output of 150 hp. The following table is applicable to the corrections that must be made at peak pressure and therefore provides an indication of the magnitude of the minor lobes at their maximum. The criteria are for a slant axis rotary engine having a wobble angle of 12.0° and wherein the radius ratio of 0.7. (The radius ratio is the radius of the hub 34 of the rotor 26 divided by the radius of the flange 40.)

TABLE

| Component | | Apex Seal Displacement | Wall Surface Mod. Necess. to Cancel Apex Seal Motion |
|---|---|---|---|
| | Clearance | | |
| Main thrust bearing 20,22 | .00040 in. | .00206 in. | .001666 in. |
| Main journal bearing 16,18 | .0030 in. | −.00078 in. | −.000631 in. |
| Rotor thrust bearing 30,32 | .0050 in. | .00239 in. | .001934 in. |
| Rotor journal bearing 28 | .0040 in. | .00093 in. | .00075 in. |
| | Deflection | | |
| Main thrust bearing 20,22 | .0033 in. | .0034 in. | .00275 in. |
| Shaft 14 | .0024 in. | .00257 in. | .002079 in. |
| Rotor thrust bearing 30,32 | .00035 in. | .00033 in. | .000267 in. |
| | Total | .0109 in. | .0088 in. |

It will be observed that clearance at the main journal bearings 16, 18 is a negative quantity tending to reduce the maximum value of the n+1 harmonic curve superimposed upon the n harmonic curve on which the wall is based. It will also be observed that the correction for each component is less than the actual apex seal displacement resulting from the takeup of clearances or deflection. This is due to the fact that the longitudinal axis of the seal (from top to bottom of the groove) for the situation of concern will not be at 90° to the wall surface 50 against which it is sealing, but rather, at an angle with respect thereto. This angle may be termed the tilt angle and, in a typical case, will be on the order of 36° if the seals are configured conventionally. Consequently, the correction for each component is equal to the product of the apex seal displacement and the cosine of the tilt angle.

Of course, in trochoidal type mechanisms, the number of factors requiring consideration will be reduced. Typically, only the main journal bearings and rotor journal bearings must be considered in determining the clearance factor and deflection will generally require only consideration of shaft deflection and housing deflection due to the noncircular geometry of the operating chamber of a trochoidal mechanism.

The magnitude of each minor lobe to either side of the maximum point can be similarly determined using standard relations interrelating pressure with volume for each relative position of the rotor with respect to the wall, of course, making appropriate correction for the change in tilt angle. In the case of a slant axis rotary mechanism such as illustrated in the drawings, the application of a n+1 harmonic curve to the basic n harmonic curve resulting in removal of material from the housing envelope at three locations shown in FIG. 2, but unnumbered, the first one of which occurs at top dead center, may have a beneficial effect. As is apparent from the preceding discussion, there is mechanical deflection of parts during operation which causes deleterious relative movement between the seals and the rotor causing the same to decrease seal life. Because, in a slant axis rotary mechanism, compression alternately takes place on opposite sides of the flange 40, and in a four stroke mechanism, every 60 degrees, if one considers the structure of FIG. 2 with a slightly different orientation of parts, i.e. where the rotor has moved 60° from the position actually shown to the right such that the left two seals 62 are in the cut-away areas mentioned, it will be recognized that at this very time, the operating volume on the opposite side of the flange will be at its top dead center with maximum pressure developed. This will have caused deflection amongst the components so as to tend to urge the surface 42 shown in FIG. 2 closer to the surface 50. Without the cut-away portions, the seals 62 would be pushed into their grooves to a greater depth, while still under pressure. Such deflection will cause unwanted relative movement while the seals are pressurized accelerating wear. But because the seals 62 are on cut-out portions of the wall 50 at this point in time, which cut-out portions are provided by the superimposition of the n+1 harmonic curve, the unwanted movement will not occur at a time when there still remains relatively high pressure in the working volume. Seal life is accordingly increased.

From the foregoing, it will be appreciated that a rotary mechanism made according to the invention eliminates or drastically minimizes apex or nose seal movement responsible for high rates of seal wear. Consequently, the invention provides a long lived rotary mechanism.

The embodiments of the invention in which an exclusive property or privilege is claimed are defined as follows:

1. A rotary mechanism comprising:

a housing defining an operating chamber having at least one wall provided with n major lobes where n is an integer of 1 or more;

a shaft journalled by said housing and including an eccentric within said chamber; and a rotor within said chamber and journalled on said eccentric, said rotor having at least one surface provided with n+1 equally angularly spaced noses or apexes for sealingly engaging said wall and defining, with said wall, n+1 working volumes;

said wall further being provided with n+1 equally angularly spaced minor lobes located to both sides of said major lobe(s) such that the angular spacing between said major lobe(s) and the adjacent minor lobes is substantially equal;

said minor lobes being directed toward said rotor and extending into said chamber a distance sufficient to compensate, to a desired degree, for (a) deflection of mechanical parts, and (b) relative movement of mechanical parts through small design clearances at their interface due to elevated pressure in one of said working volumes.

2. The rotary mechanism of claim 1 wherein said mechanism is a slant axis rotary mechanism and said operating chamber has two said walls, said walls facing each other and being generally radially extending, said rotor having a peripheral, radially extending flange with opposed sides of said flange each being one of said surfaces so that there are said n+1 working volumes on each side of said flange, the noses or apexes on one of said surfaces being angularly staggered with respect to the noses or apexes on the other of said surfaces.

3. A rotary mechanism comprising:

a housing defining an operating chamber having a wall configuration based on a desired geometric shape which is an n order harmonic curve where n is an integer of 1 or more;

a shaft journalled in said housing and having an eccentric within said chamber;

a rotor within said chamber and journalled on said eccentric and having a working surface based on said desired geometric shape and which is an n+1 order harmonic curve to define n+1, equally angularly spaced apexes or noses on said surface;

n+1 seal means carried by said rotor, one at each apex or nose; and timing gearing means for establishing relative rates of rotation between said housing, said shaft and said rotor;

said wall further being defined by n+1 harmonic curve superimposed on said n order harmonic curve.

4. The rotary mechanism of claim 3 wherein said mechanism is a four-cycle engine and n=2.

* * * * *